US005172910A

United States Patent [19]

Ashurst

[11] Patent Number: 5,172,910

[45] Date of Patent: Dec. 22, 1992

[54] METHOD AND APPARATUS FOR IMPROVING BOWLING BALL CONTROL

[76] Inventor: Donald O. Ashurst, P.O. Box 1878, Gardnerville, Nev. 89410

[21] Appl. No.: 743,971

[22] Filed: Aug. 12, 1991

[51] Int. Cl.[5] ..... A63B 71/04

[52] U.S. Cl. ..... 273/54 B

[58] Field of Search ..... 273/54 R, 54 B, 64; 2/21, 161, 163

[56] References Cited

U.S. PATENT DOCUMENTS

| | | | |
|---|---|---|---|
| 667,338 | 2/1901 | Rogers | 2/21 |
| 852,972 | 5/1907 | Mackay | 2/21 |
| 882,117 | 3/1908 | McElhone | 2/21 |
| 1,863,960 | 6/1932 | Aronson | 273/54 B |
| 2,391,851 | 12/1945 | Willard | 2/21 |
| 3,038,723 | 6/1962 | Bergendorf | 273/54 B |
| 3,046,561 | 7/1962 | Marinese et al. | 273/54 B |
| 3,248,112 | 4/1966 | Metzger | 273/54 B |
| 3,880,426 | 4/1975 | Morse | 273/54 B |
| 4,062,540 | 12/1977 | Calentine | 273/54 B |
| 4,257,596 | 3/1981 | Capella | 273/54 B |
| 4,689,828 | 9/1987 | Brewer | 2/21 |

OTHER PUBLICATIONS

"Locksley" Equipment Catalog, Archery Division, Ben Pearson, Inc., 1965, p. 17, 2/21 XR.

*Primary Examiner*—V. Millin

*Assistant Examiner*—William M. Pierce

[57] ABSTRACT

A method and apparatus for providing finger and thumb protection and enhanced control by the fingers and thumb of a bowler utilizing a bowling ball which has finger and thumb holes drilled in it in which the fingers and thumb of the bowler are protected by detachable attached spacing and protecting overlays.

2 Claims, 3 Drawing Sheets

FIG. 5.
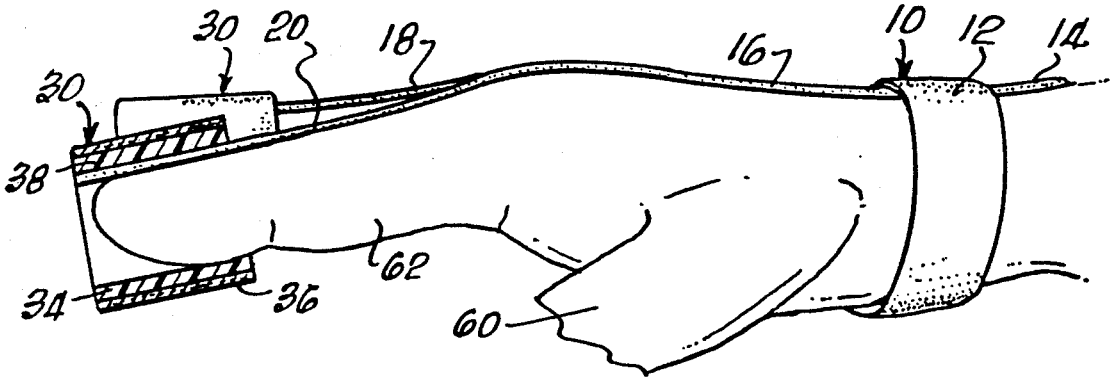
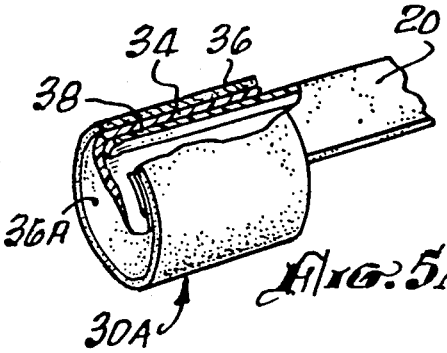
FIG. 5A.
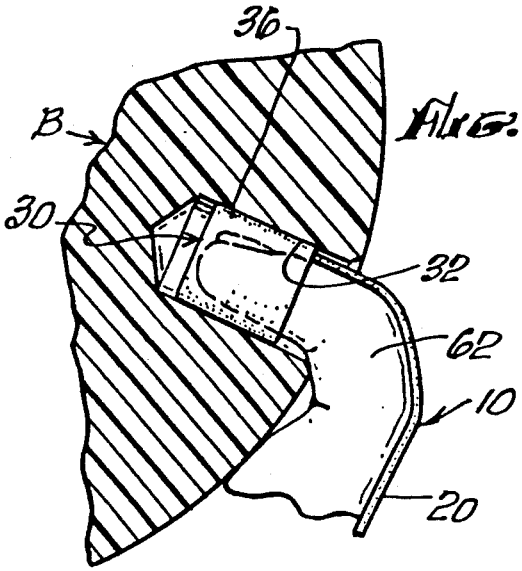
FIG. 6.
FIG. 8.
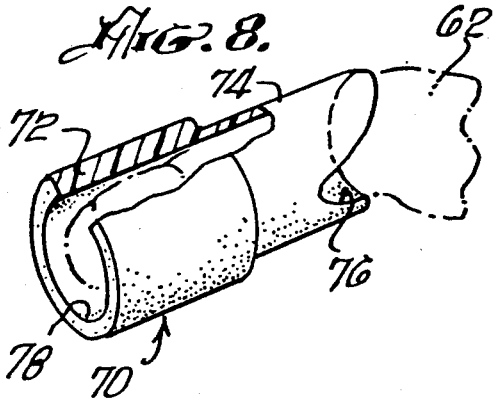
FIG. 7.
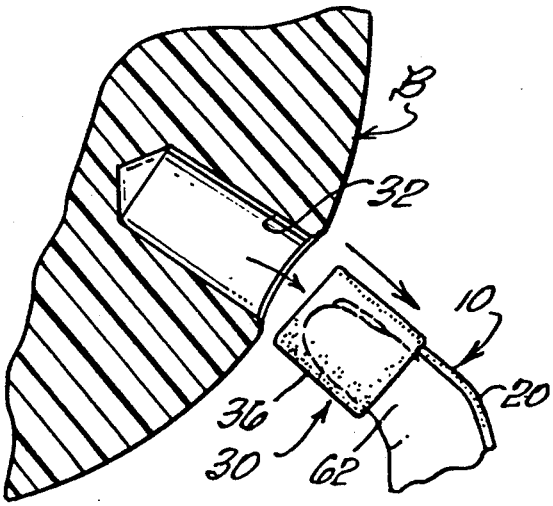

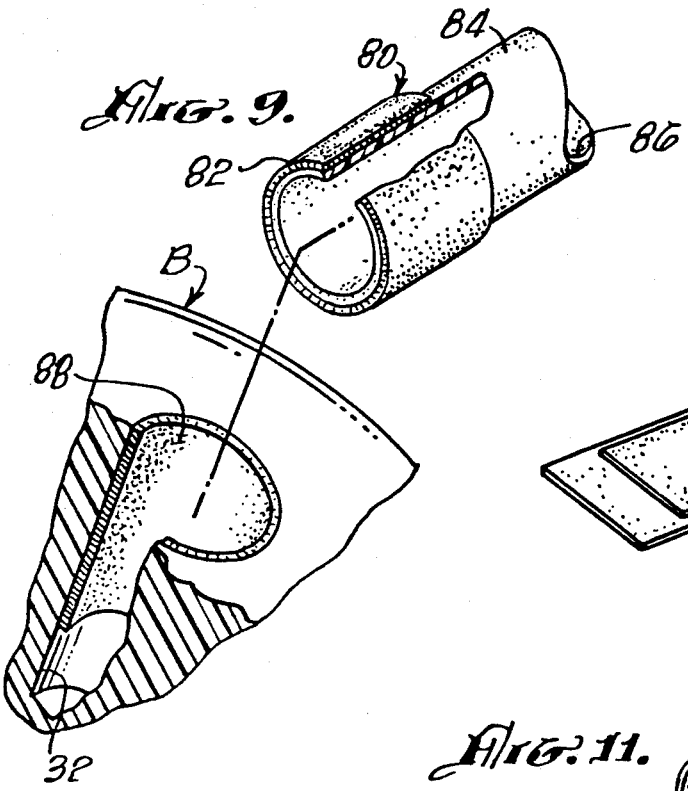
FIG. 9.
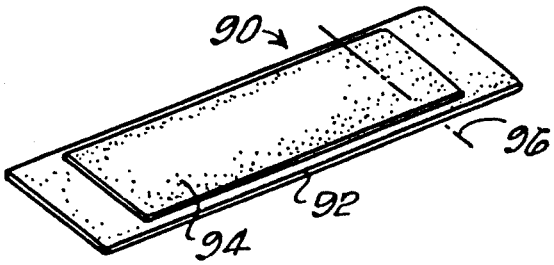
FIG. 10.
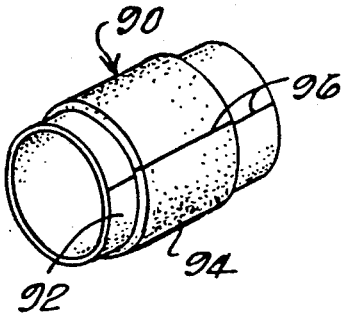
FIG. 11.
FIG. 12.
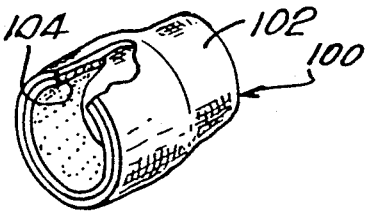
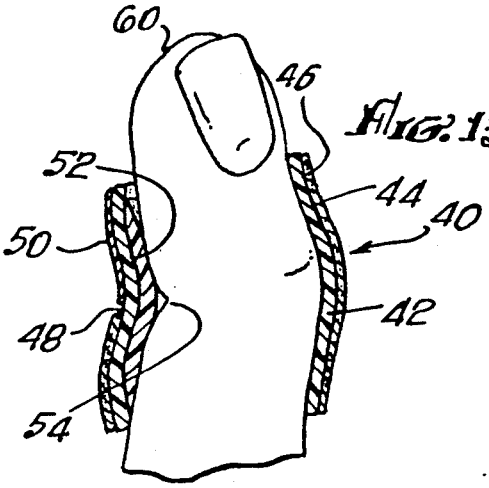
FIG. 13.
FIG. 14.
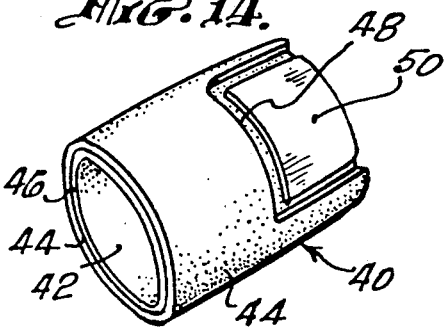

METHOD AND APPARATUS FOR IMPROVING BOWLING BALL CONTROL

CROSS REFERENCE TO RELATED PATENT APPLICATIONS

There are no patent applications filed by me related to the within patent application.

BACKGROUND OF THE INVENTION

I. Field of the Invention

This invention is in the general field of bowling;

The invention is even more directly in the field of methods and apparatus for improved control of bowling balls;

The invention is even more particularly directed to a method and apparatus for improved thumb and finger control when releasing a bowling ball;

The method and apparatus is even more directly and particularly in the field of finger mounted control overlays to be used by a person bowling.

II. Description of the Prior Art

In bowling, particularly the type bowling ball which has drilled holes into which fingers and the thumb may be inserted and by which the ball is held and thrown and released from the hand, it has been customary in the past to supply certain materials such as rosin, powder, and the like to be used within the hole to aid in one manner or another in controlling the release characteristics when the bowling ball is released by the bowler. It has also been customary and quite common to insert special materials such as a sleeve of plastic material or the like into the holes for the purpose of attempting to obtain improved holding and release characteristics.

The present invention involves the use of overlays applied to the fingers and to the thumb in order to assist in obtaining maximum ball control.

There is no art heretofore known to me in which special finger overlays are used by a bowler.

SUMMARY OF THE INVENTION

Bowling is an extremely popular sport in the United States and many other countries of the World. The type of bowling I am referring to is the type wherein large heavy balls are utilized and in which holes are drilled into which fingers and a thumb may be inserted for holding and bowling the ball. Generally there will be three holes drilled into a ball, one for the thumb, and two to accommodate two fingers. Sometimes only two holes may be used and it is conceivable to use more than three holes.

Regardless of the number of holes used in the bowling balls, the purpose of the holes is to provide a bowler with the means to swing the ball and to release it in such a manner as to apply desired spin and other characteristics to the ball depending upon the circumstance of the particular bowl involved.

The contact of the fingers within the holes is very important. Sometimes materials such as rosin or powder may be used for purposes of increasing or decreasing friction and the like. Also, it has been quite common in recent years to insert fixed, or adjustable, sleeves into holes in order to alter the characteristics of handling and the thumb and finger release.

The goal of achieving maximum control has been ongoing and many persons have worked in this field with varying results.

Another reason for some of the inserts is that over a period of time in bowling a person's fingers may swell or may shrink in dimension. In severe cases a bowler will suffer severe callouses, blisters, and even bruised and bloodied thumb or fingers. Not only is this painful, but it also reduces the bowler's ability properly to control his ball during extended playing. Even with the best of inserts in balls many of these problems continue to exist.

I have now developed a method and apparatus by which, and in which, I apply appropriately formed, and specially configured overlays around the thumb and fingers involved. These overlays are configured and made of material such that the desired appropriate release control characteristics many be imparted as they are withdrawn from the ball when the ball is released. Thus, the finger itself is not rubbing against the walls of the hole or the surface of the insert, but rather the overlay rubs against the walls of the holes in the ball thus protecting the fingers while at the same time imparting the desired release characteristics as the ball is released.

Additionally, with these overlays it is possible to have as tight a fit as desired into the hole, with no problem of releasing the ball, such as can occur if a finger fits too tightly within the hole.

In one preferred form I apply the overlays by means of a specially designed wrist band assembly as is set forth in the specifications and description of a preferred embodiment which follows.

It is an object of this invention to provide a means control and to protect a bowler's fingers from injury;

Another object of this invention is to provide a method and apparatus for equipping a bowler with finger overlay and protection devices which allow him to have full control and release characteristics;

Another object of this invention is to provide such a method and apparatus as is described wherein a bowler's fingers can exert perfect hole contact without the danger of being stuck within the ball itself.

The foregoing and other objects and advantages will become apparent to those skilled in the art upon reading the description of a preferred embodiment which follows, in conjunction with review of the appended drawings.

BRIEF DESCRIPTION OF THE DRAWINGS

FIG. 5 is an enlarged fragmentary side elevation, partly in section, of a strap assembly attached to a bowler's hand, and carrying finger inserts suitable to practice the method of this invention;

FIG. 5A is a fragmentary perspective view of the finger insert of FIG. 5, shown partly in section;

FIG. 6 is a fragmentary sectional view of the finger insert of FIG. 5 inserted into a finger hole of a bowling ball;

FIG. 7 is a view similar to FIG. 6, but showing the finger and finger insert withdrawn from the finger hole of the bowling ball FIG. 8 is an alternate embodiment of a finger insert;

FIG. 9 is an exploded perspective, with parts in section, of a second alternate embodiment of the finger insert;

FIG. 10 is a perspective view of a strip assembly from which a finger insert can be formed;

FIG. 11 is a perspective view of a finger insert formed from the strip assembly of FIG. 10;

FIG. 12 is yet another alternate embodiment of finger insert;

FIG. 13 is a section through the thumb attachment of FIG. 4 as it appears on the thumb; and FIG. 14 is an underside perspective of the FIG. 4 thumb insert.

DESCRIPTION OF A PREFERRED EMBODIMENT

Figure 1:
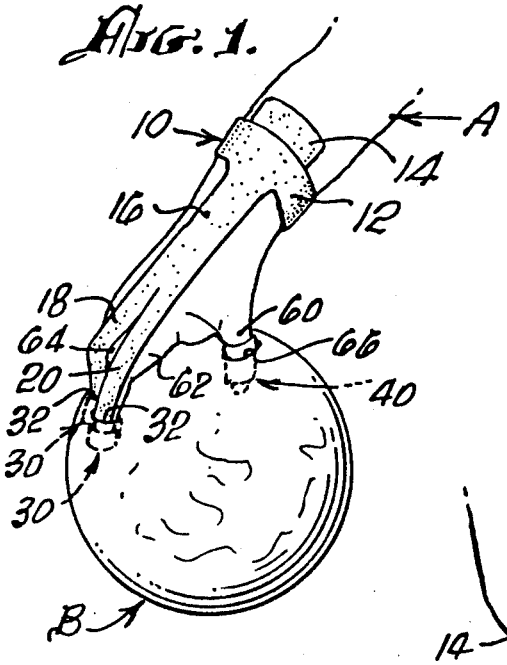
FIG. 1 is a fragmentary perspective view of a bowler's hand gripping a bowling ball with the apparatus of this invention being used.

FIG. 1, illustrates a hand A of a bowler gripping and holding a bowling ball B. The bowler's hand A is shown with the thumb 60 and fingers 62–64 inserted in a bowling ball B.

Strap assembly 10 is shown to comprise a circular band portion 12 over the wrist portion of the bowler's hand. The strap is constructed of a flexible stretchable material, or may be fastened by means of hook and loop material as is well known in the art. An extension flap 14 can be added to the band portion to further stabilize the strap assembly to the hand.

An elongated extension 16 of the band divides into two smaller extension 18 and 20. These extensions provide a means for attachment to finger insert assemblies 30.

Each assembly 30 is designed to be inserted into one of a pair of holes 32 formed in a conventional bowling ball. The bowling ball finger holes 32 are sized to receive the insert assembly 30.

The assembly 30 is formed with a resilient tubular portion 38 of a size to be slipped over a bowler's finger. This tubular portion is adhered to the extension 18 or 20, and has an outer layer of material 36 that will provide the gripping or retaining surface in the wall of the hole 32. This outer strip 36 can be of a material such as chamois, or the like, and can be affixed to the member 34 and 38.

The alternate embodiment 30A of FIG. 5A illustrates that the tubular member 34 can have a closed end 36A so as to keep the finger insert assembly from allowing the bowler's finger from moving too deeply past the assembly 30 into the bowling ball finger hole.

Figure 4:
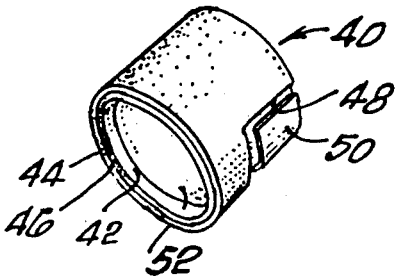
FIG. 4 is an enlarged perspective view of a preferred thumb attachment to practice the method of this invention.
Figure 2:
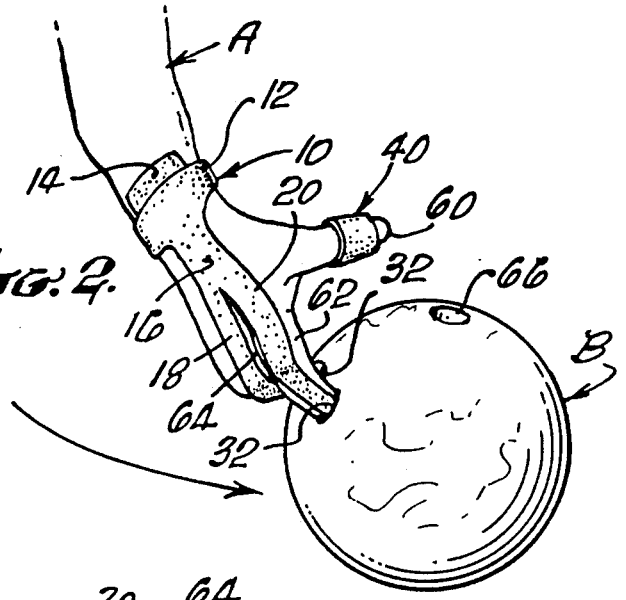
FIG. 2 is a view similar to FIG. 1 with the bowler putting the bowling ball into motion and with the thumb already having been released.
Figure 3:
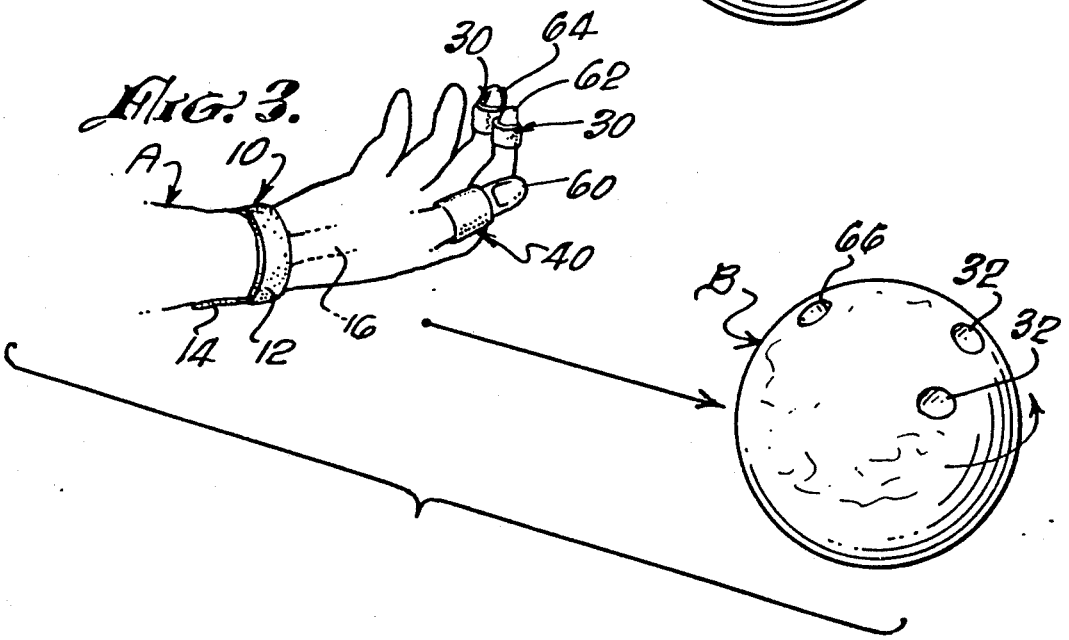
FIG. 3 is a view similar to FIGS. 1 and 2 showing the bowling ball fully released while in motion toward the bowling pins.

The thumb insert member is shown in detail in FIGS. 4, 13 and 14. The thumb insert is generally designated by reference numeral 40 is shown to be constructed of a tubular resilient member 42. Surrounding this tubular member 42 is a layer of material 44, such as chamois, and the like, to provide a gripping surface within a thumbhole 66 located in the bowling ball B. This outer layer of material is secured at 44 by means of adhesive, and the like.

Some of the outer gripping material is shown to be cut away at 48 in order to allow a slicker material surface to be added as indicated in FIGS. 13 and 14. This slicker material 50 permits the bowling ball to be released more easily to give loft to the ball during such release.

In order to insure that the thumb insert assembly 40 does not slip off the bowler's thumb, a formed, raised portion 52 is added to the inside portion of the tubular member 42. This raised portion can be molded integrally with the member 42 or affixed to it by conventional adhesives. It can be seen that this raised portion fits into the first joint of the thumb to further insure that the insert assembly 40 does not slip off easily during bowling.

FIG. 8 illustrates an alternative embodiment 70 of a finger insert constructed with an enlarged diameter sleeve portion 72 which reduces down to a thinner portion 74. A notched out portion 76 permits the assembly to be slipped over the end of a bowler's finger and yet permits free movement of the first joint. The inside diameter 78 of the sleeve 72 is of a diameter which permits good adherence to the finger without danger of slipping off during the ball release.

Another alternate embodiment of finger insert is shown in FIG. 9. In this case the insert 80 is formed with an outer layer 82 of material with a given friction coefficient attached to a sleeve member 84. The notch 86 is provided for ease of operation around a finger joint. The hole in the bowling ball B is lined with material 88 affixed of a given friction coefficient to react in a desired manner with material 82.

The finger insert of FIG. 11 is shown at 90 to be constructed of two separate sheets of materials designated at 92 and 94. The two materials are affixed together by bonding or other fastening means, as shown in FIG. 10, and then trimmed to a size to better fit the bowler's measurements. After trimming along line 96, the strip assembly is joined together at that line, as seen in FIG. 11, to form the finger insert.

Another alternate embodiment is shown at 100 in FIG. 12. This insert is formed from a flexible woven material 102 and is provided with finger tube 104. The flexibility of the material allows it to grip the finger at the reduced diameter portion of the sleeve 102.

While the method and embodiments of this invention specifically shown and described are fully capable of achieving the objects and advantages desired, ti it to be understood that such embodiments have been shown for purposes of illustration only and not for purposes of limitation.

I claim:

1. An overlay for a bowler's thumb comprising a first cylinder of material suitable to be in contact with a human thumb and having a ridge over a portion of its interior suitable to be gripped at the interior joint of a thumb; a second cylinder of a flexible material bonded to and surrounding said first cylinder; and a third cylinder of a material suitable to contact the interior walls of a hole in a bowling ball bonded to and surrounding said second cylinder.

2. The overlay of claim 1 wherein said third cylinder is formed of chamois.

* * * * *